US008152472B2

(12) United States Patent
Jia

(10) Patent No.: US 8,152,472 B2
(45) Date of Patent: Apr. 10, 2012

(54) BLADE STRUCTURE FOR HEAT SINK FANS

(75) Inventor: Zih-Chou Jia, Hsin Chuan (TW)

(73) Assignee: Asia Vital Components Co. Ltd., New Taipei (TW)

( * ) Notice: Subject to any disclaimer, the term of this patent is extended or adjusted under 35 U.S.C. 154(b) by 626 days.

(21) Appl. No.: 12/354,880

(22) Filed: Jan. 16, 2009

(65) Prior Publication Data

US 2010/0183445 A1 Jul. 22, 2010

(51) Int. Cl.
*F04D 29/38* (2006.01)

(52) U.S. Cl. ..... 416/223 R; 416/93 R; 416/193 R; 415/206; 415/208

(58) Field of Classification Search ..... 416/193 R, 416/223 R, 93 R; 415/206
See application file for complete search history.

(56) References Cited

U.S. PATENT DOCUMENTS 6,761,539 B2 * 7/2004 Cipelletti et al. ..... 416/228
2002/0159885 A1 * 10/2002 Liang et al. ..... 415/206
2003/0098144 A1 * 5/2003 Uselton et al. ..... 165/104.34

* cited by examiner

*Primary Examiner* — Dung A. Le

(57) ABSTRACT

A fan blade for heat sink fans is provided. The fan blade includes a wheel hub and a plurality of blades which is disposed around the rim of the wheel hub. The surfaces of the blade fans are designed with protruding or recessing inhibiting part. The flow rate on the blade surfaces is made unsteady by the inhibiting part as the airflow is flowing by to form a constant air flow impact and generate a boundary layer on the blades effectively. The effective second order distribution of the pressure rise is formed, and the effective working area of the fan is expanded. The improvement increases the static pressure and lowers the noise.

4 Claims, 4 Drawing Sheets

BLADE STRUCTURE FOR HEAT SINK FANS

BACK GROUND OF THE INVENTION

1. Field of the Invention

The present utility invention relates to a fan blade for heat sink fans, and more particularly, to a heat sink fan structure which has blades designed with protruding or recessing inhibiting part constructions in the fan blades in order to enhance the heat dissipating effect.

2. Description of Related Art

With the rapid development of the electronic science and technology industry, the performance of electric elements is improved gradually. The quantity of chipsets in electronic devices such as integrated circuit keeps increasing, and the operation and process speed of the chipsets is getting faster and faster. Correspondingly, the heat is increased, which is emitted when elements such as the chipsets are working. If the heat is not emitted out, the performance of the electric element will be affected. The higher the temperature of the electric element is, the slower the operation speed thereof is, moreover it is possible that the electric element will get burned. To ensure the normal operation of the electric equipment and to prolong the lifespan, heat dissipating process for electric element is getting more and more important. Therefore, those skilled in the art are engaged in developing heat sink elements with greater heat dissipating efficacy.

The heat sink fan plays an important role in heat dissipating of current electric elements, wherein the fan blade has a strong impact on the air pressure and air volume generated by the fan. In the prior art of conventional heat sink fan is as shown in FIG. 1, which includes a wheel hub 100 and a plurality of blades 200 disposed along the rim of the wheel hub. The surfaces of the blades are smooth, so when airflow incidence is large, boundary layer separation will be included, furthermore, to induce air backflow, therefore the static pressure will be decreased, and the noise will be increased.

Due to the defects in the construction of conventional heat sink fan blades mentioned above, to improve the effect of conventional heat sink fan, the inventor of the present utility invention focuses on the construction of the fan blades in the existed conventional heat sink fan, looking for a more suitable solution and improvement way, therefore the present utility invention is created. By implementing the present utility invention, the formation of the boundary layer on the blade is delayed effectively, an effective second order distribution of the pressure rise is formed, the effective working area of the fan is expanded, the static pressure is increased, the noise is lowed and the heat dissipating efficacy of the heat sink fan is enhanced.

SUMMARY OF THE INVENTION

The main purpose of the present utility invention relates to providing a fan blade structure which dissipates the heat rapidly and effectively. The detailed construction and assembly feature about the present utility model invention will be illustrated below by the following embodiments with reference to the appended drawings.

In order to make the aforementioned object, features and advantages of the present utility invention will be more readily comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF THE INVENTION

These present utility invention is more specifically described in the following paragraphs by reference to the drawings attached by way of examples.

Figure 1:
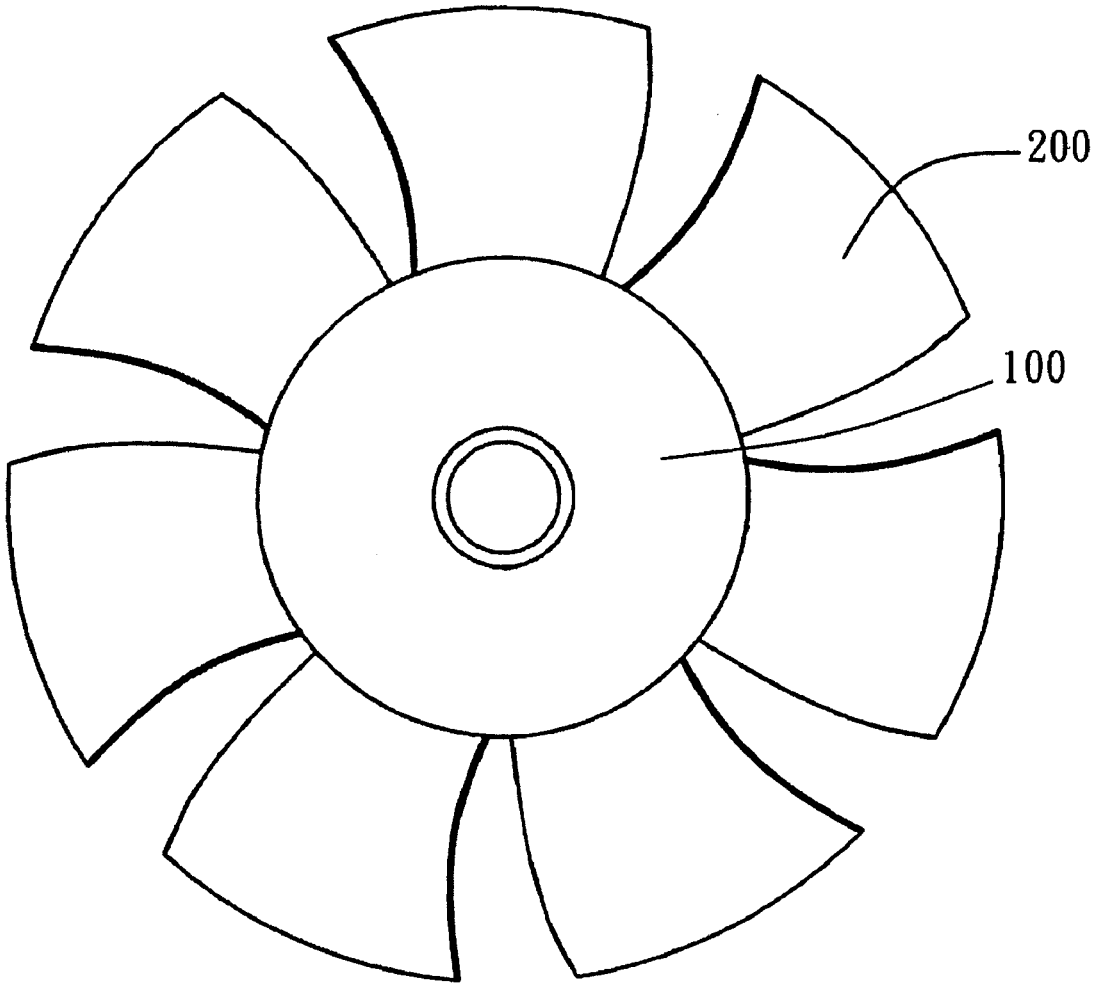
FIG. 1 (Prior Art)
FIG. 1 is a schematic view of the fan blade of a conventional heat sink fan in one prior art.
Figure 2:
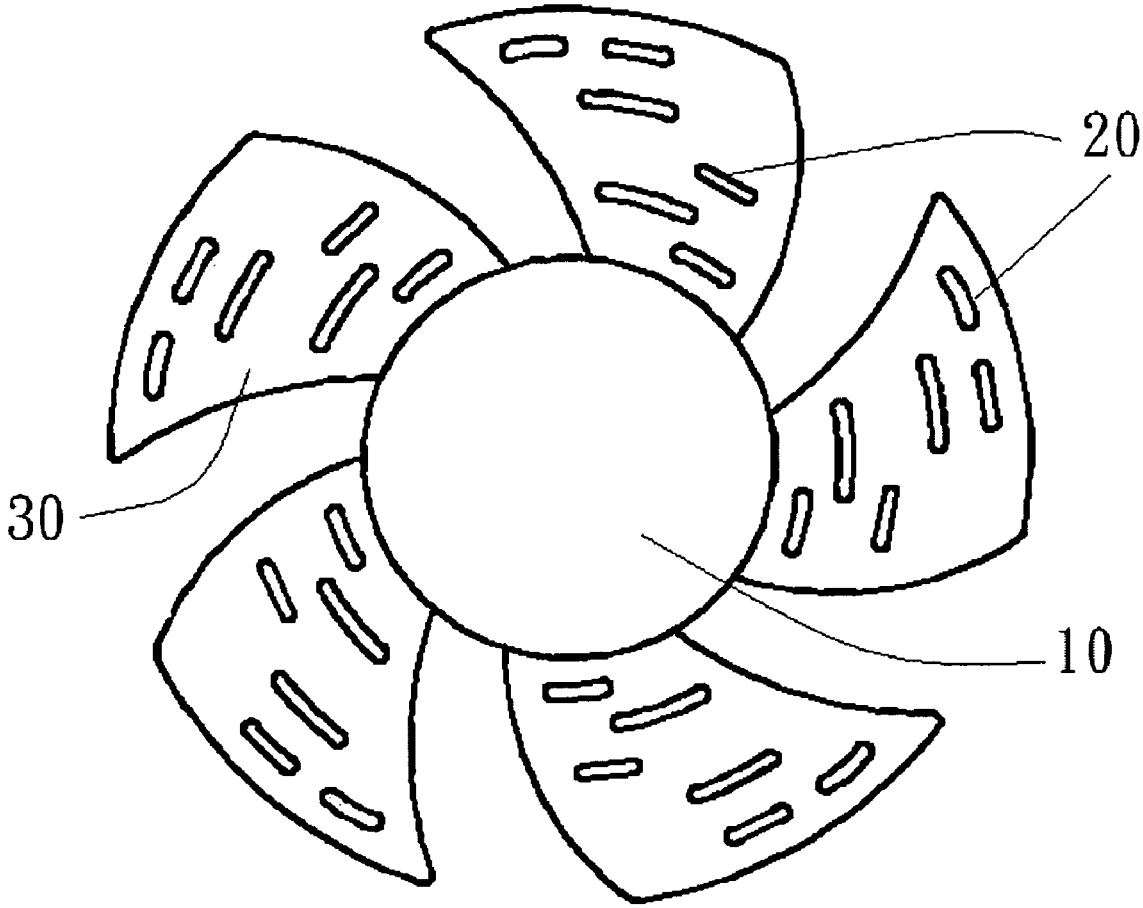
FIG. 2 is a schematic view of the first embodiment of the blade of the present utility model invention.
Figure 3:
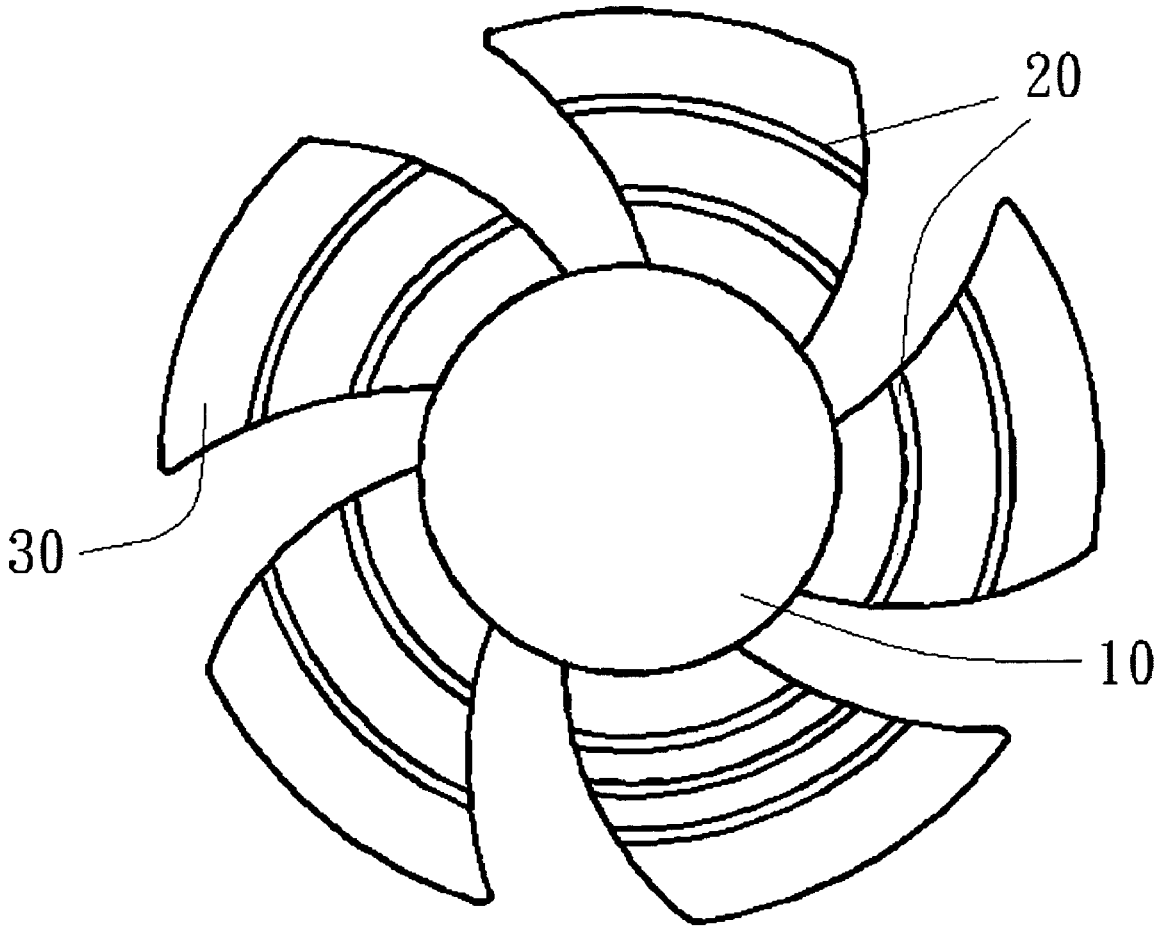
FIG. 3 is a schematic view of the second embodiment of the blade of the present utility model invention.
Figure 4:
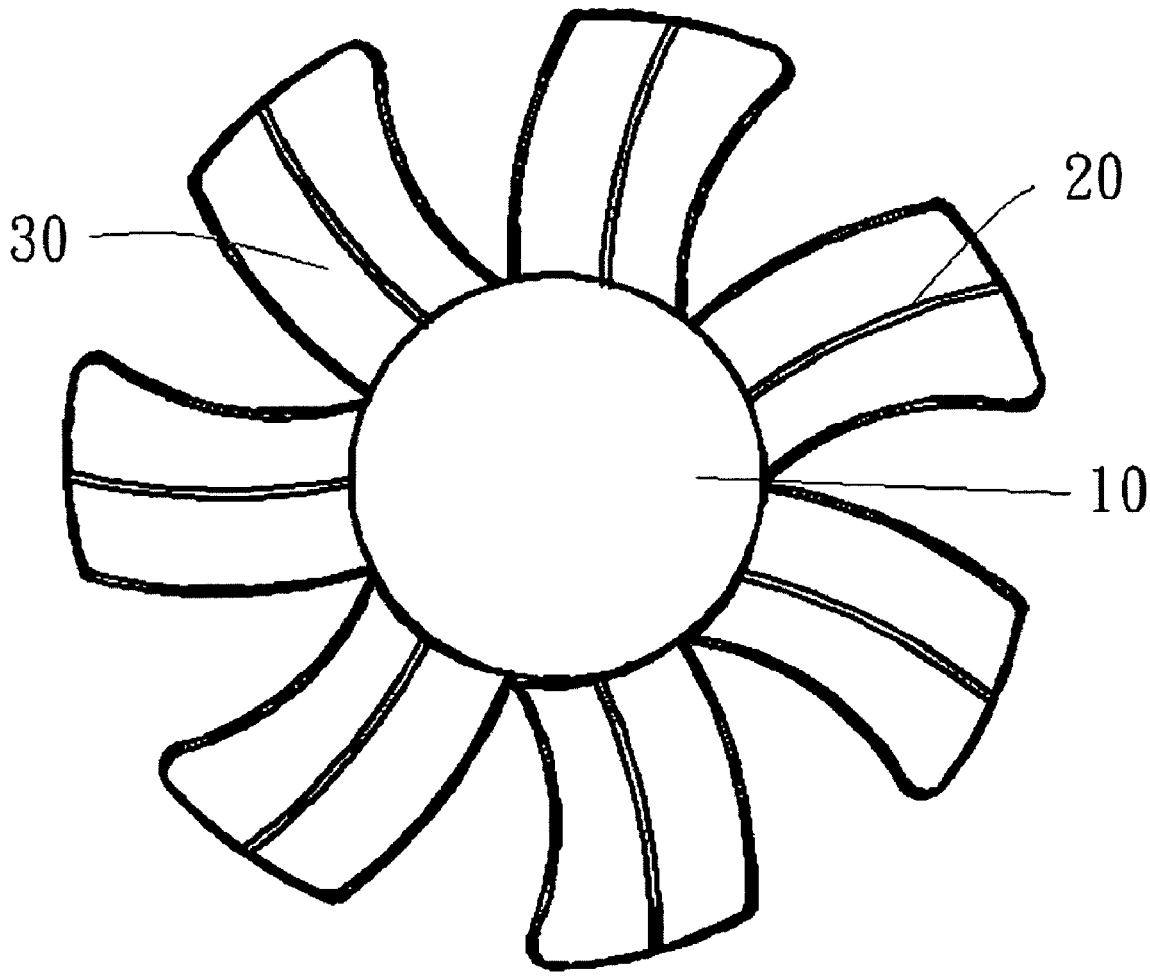
FIG. 4 is a schematic view of the third embodiment of the blade of the present utility model invention.

Referring to FIGS. 2, 3 and 4, they are schematic views of the heat sink fan of the present utility invention, wherein the heat sink fan comprises a wheel hub 10 and a plurality of blades 30, which is disposed around the rim of the wheel hub. Moreover the surfaces of the plurality of blades are disposed with protruding or recessing inhibiting parts 20. When the fan blades rotate, the flow rate on the blade surfaces is made unsteady by the protruding or recessing inhibiting parts 20 as the air flow is flowing by to form a constant airflow impact. Therefore the formation of the boundary layer on the blades is delayed, the effective second order distribution of the pressure rise is formed, expanding the effective working area of the fan, as well as increasing the static pressure of the fan, and lowering the noise generated by the fan down, so that a rapid and effective heat sink efficacy of the fan could be achieved.

Moreover, the pattern of the inhibiting parts of the present utility invention is constituted by protruding one side of the blade while recessing the other corresponding side. Besides, relative to the center of the wheel hub 10, concentric circles arrangement mode can be used, which is presented as a continuous or discontinuous aspect. Moreover a stagger or non-stagger arrangement mode can be constituted by using the pattern of one segment of protruding inhibiting part followed by one segment of recessing inhibiting part 20 as well as using a reverse recessing, protruding pattern.

Referring to FIG. 3 again, it is another implementation aspect of the inhibiting part of the present utility invention. At least one continuous protruding or recessing inhibiting part 20 is disposed on each surface of the plurality of blades. The protruding or recessing inhibiting parts 20 are arranged in concentric circles relative to the center of the wheel hub 10. The number of the inhibiting part 20 on each of the plurality of blades 30 is the same or not.

Referring to FIG. 4, it is a further implementation aspect of the inhibiting part of the present utility invention, wherein the inhibiting part 20 is disposed according to the protrusion or recess of the curvature of the fan blades. The protruding or recessing inhibiting part 20 is continuous or discontinuous extension facing to the center direction of the wheel hub 10. As the foregoing description, when the fan blades rotate, the flow rate on the blade surfaces is made unsteady by the protruding or recessing inhibiting parts disposed on the blades of the present utility model invention as the air flow is flowing by to form a constant airflow impact. Therefore the formation of the boundary layer on the blades is delayed, the effective second order distribution of the pressure rise is formed, expanding the effective working area of the fan, increasing the static pressure of the fan, and lowering the noise generated by the fan down, so that a rapid and effective heat sink efficacy of the fan could be achieved.

Above all, in the heat sink fan blade of the present utility invention, the construction design of the protruding or recessing inhibition part disposed on the surface of the blade thereof has the following advantages comparing to conventional prior art:

(1) The molding operation of the heat sink fan blade of the present utility invention is simple, while an adequate heat dissipating effect is achieved.

(2) The design of the inhibiting part of the blades of the present utility invention not only strengthened the fan blades, but also has an aesthetically pleasing effect.

(3) The construction of the protruding or recessing inhibiting parts of the present utility invention delays the formation of the boundary layer on the blades effectively expands the effective working area of the fan, increases the static pressure of the fan, and lowers the noise generated when the fan is operating.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It will be apparent to those skilled in the art that various modifications and variations can be made to the structure of the present utility model invention without departing from the scope or spirit of the invention. In view of the foregoing, it is intended that the present utility model invention cover modifications and variations of this invention provided they fall within the scope of the following claims and their equivalents.

What is claimed is:

1. A blade structure for heat sink fans comprising:

a wheel hub; and a plurality of blades being disposed along the rim of the wheel hub;

characterized by that a plurality of protruding or recessing inhibiting parts are disposed on two opposite sides of each of the blades in a way of protruding one of the sides and recessing the other of the sides; when the fan blades rotate, the flow rate on the surfaces of the two sides of the blades is made unsteady as the airflow is flowing by to form a constant airflow impact, generating a boundary layer on the blades effectively.

2. The blade structure for heat sink fans as claimed in claim 1, wherein the inhibiting parts are relative to the center of the wheel hub with concentric circles arrangement mode, and presented as a continuous or discontinuous aspect.

3. The blade structure for heat sink fans as claimed in claim 1, wherein the inhibiting parts are provided with an interlaced or non-interlaced arrangement mode which is constituted by one segment of protrusion followed by one segment of recess or by a reverse pattern thereof.

4. The blade structure for heat sink fans as claimed in claim 1, wherein the respective inhibiting part is disposed according to the the curvature of the fan blades, and continuous or discontinuous extension facing to the center of the wheel hub.

* * * * *